US008146658B2

(12) United States Patent
Howard et al.

(10) Patent No.: US 8,146,658 B2
(45) Date of Patent: Apr. 3, 2012

(54) PROVIDING A SENSOR ARRAY

(75) Inventors: Pete Howard, Bellville, TX (US); Anthony Veneruso, Paris (FR); Fabien Cens, Massy (FR); Frederic Pauchet, Montigny sur Loing (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/904,401

(22) Filed: Oct. 14, 2010

(65) Prior Publication Data

US 2011/0107834 A1 May 12, 2011

Related U.S. Application Data

(62) Division of application No. 11/688,089, filed on Mar. 19, 2007, now Pat. No. 7,735,555.

(60) Provisional application No. 60/787,592, filed on Mar. 30, 2006, provisional application No. 60/745,469, filed on Apr. 24, 2006, provisional application No. 60/747,986, filed on May 23, 2006, provisional application No. 60/805,691, filed on Jun. 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007.

(51) Int. Cl.
*E21B 47/00* (2012.01)

(52) U.S. Cl. ..... 166/250.11; 166/66

(58) Field of Classification Search ..... 166/65.1, 166/250.01, 250.11, 66
See application file for complete search history.

(56) References Cited

U.S. PATENT DOCUMENTS

| | | | | |
|---|---|---|---|---|
| 6,009,216 | A * | 12/1999 | Pruett et al. | 385/12 |
| 6,727,828 | B1 * | 4/2004 | Malone et al. | 340/854.9 |
| 6,888,972 | B2 * | 5/2005 | Berg et al. | 385/12 |
| 2003/0219190 | A1 * | 11/2003 | Pruett | 385/12 |
| 2008/0056639 | A1 * | 3/2008 | MacDougall et al. | 385/12 |

* cited by examiner

*Primary Examiner* — Kenneth L Thompson
(74) *Attorney, Agent, or Firm* — Brandon S. Clark; Rodney Warfford

(57) ABSTRACT

To assemble a sensor array having plural sections, the sections of the sensor array are sealably attached, where the sections include sensors and cable segments. An inert gas is flowed through at least one inner fluid path inside the sensor array when the sections of the sensor array are being sealably attached.

4 Claims, 6 Drawing Sheets

PROVIDING A SENSOR ARRAY

CROSS-REFERENCE TO RELATED APPLICATIONS

This claims the benefit under 35 U.S.C. §119(e) of U.S. Provisional Application Ser. No. 60/865,084, filed Nov. 9, 2006 and U.S. National application Ser. No. 11/767,908, filed Jun. 25, 2007, which is hereby incorporated by reference.

This is a divisional of U.S. Ser. No. 11/688,089, entitled "Completion System Having a Sand Control Assembly, an Inductive Coupler, and a Sensor Proximate to the Sand Control Assembly," filed Mar. 19, 2007, now U.S. Pat. No. 7,735,555 which claims the benefit under 35 U.S.C. §119(e) of the following provisional patent applications: U.S. Ser. No. 60/787,592, entitled "Method for Placing Sensor Arrays in the Sand Face Completion," filed Mar. 30, 2006; U.S. Ser. No. 60/745,469, entitled "Method for Placing Flow Control in a Temperature Sensor Array Completion," filed Apr. 24, 2006; U.S. Ser. No. 60/747,986, entitled "A Method for Providing Measurement System During Sand Control Operation and Then Converting It to Permanent Measurement System," filed May 23, 2006; U.S. Ser. No. 60/805,691, entitled "Sand Face Measurement System and Re-Closeable Formation Isolation Valve in ESP Completion," filed Jun. 23, 2006; U.S. Ser. No. 60/865,084, entitled "Welded, Purged and Pressure Tested Permanent Downhole Cable and Sensor Array," filed Nov. 9, 2006; U.S. Ser. No. 60/866,622, entitled "Method for Placing Sensor Arrays in the Sand Face Completion," filed Nov. 21, 2006; U.S. Ser. No. 60/867,276, entitled "Method for Smart Well," filed Nov. 27, 2006; and U.S. Ser. No. 60/890,630, entitled "Method and Apparatus to Derive Flow Properties Within a Wellbore," filed Feb. 20, 2007. Each of the above applications is hereby incorporated by reference.

TECHNICAL FIELD

The invention relates generally to providing a sensor array that has plural sensors and cable segments interconnecting the plural sensors.

BACKGROUND

A completion system is installed in a well to produce hydrocarbons (or other types of fluids) from reservoir(s) adjacent the well, or to inject fluids into the well. Sensors are typically installed in completion systems to measure various parameters, including temperature, pressure, and other well parameters that are useful to monitor the status of the well and the fluids that are flowing and contained therein.

However, deployment of sensors is associated with various challenges. One challenge is the issue of leaks of well fluids when a connection between a sensor and a cable segment is not properly sealed. Other challenges are associated with the moisture or polluting vapors that may be sealed within the sensor or cable, especially if sealing is accomplished by welding or other process that may directly damage wires, electrical insulation and electronic components or indirectly cause damage by liberating electrically conductive particulates and corrosive fumes. Exposing sensitive sensor components and associated electronic circuitry can cause damage to such components.

SUMMARY

In general, according to an embodiment, a method of making a sensor array having plural sections includes sealably attaching the sections of the sensor array, where the sections include sensors and cable segments. An inert gas is flowed through at least one inner fluid path inside the sensor array when the sections of the sensor array are being sealably attached.

In general, according to another embodiment, a sensor array includes plural sensors having corresponding sensor housings, and plural cable segments to interconnect the sensors, where the cable segments have respective cable housings. Heat insulating structures are positioned to protect the sensors and cable segments during welding to interconnect the sensor housings and cable housings.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a sensor array is provided that has multiple sensors and cable sections, where the sensors have respective sensor housings, and the cable segments have respective cable housings. The sensor housings and cable housings are sealably connected together, such as by welding. Each sensor has a sensing element and associated electronic circuitry, and each cable segment has one or more wires that electrically connect to the sensing elements. To protect the wires from heat that can be generated during a sealing procedure to interconnect the sensor housings and cable housings, heat insulating structures are positioned to protect the wires from such heat. The sealing connection of sensor housings and cable housings protects the sensors from exposure to harsh well fluids, which can damage the sensors.

In addition, manufacturing techniques are provided to ensure the quality of the sensor array that is built. Techniques are provided to eliminate or purge corrosive gases, moisture, oxygen, and welding by-products from the sensor array.

Moreover, a pressure test can be performed to test the sealing connections between the sensor housings and cable housings. Also, the sensor array can be filled with an inert gas to stave off corrosion. Also, in accordance with some embodiments, customized adjustments to the sensor array can be performed at the job site, such as on a rig.

Figure 1:
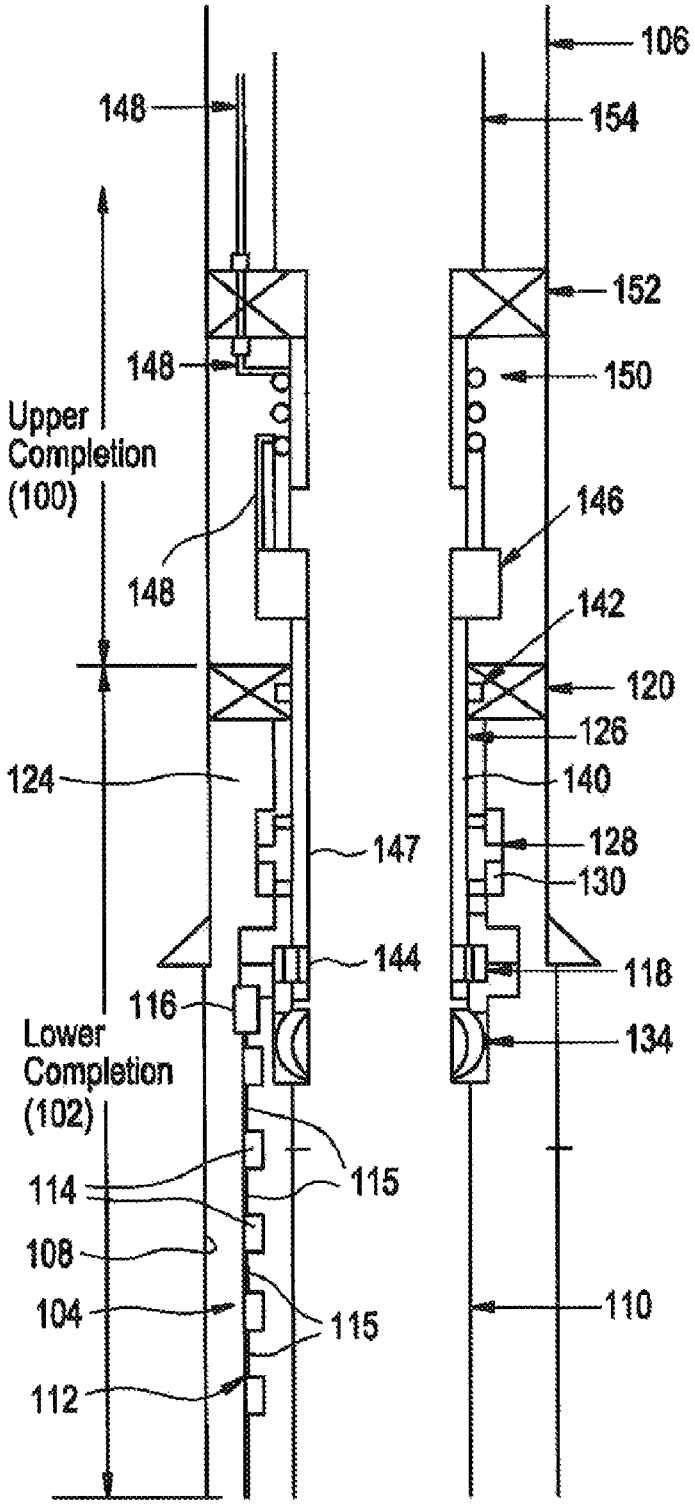
FIG. 1 illustrates an example completion system deployed in a well, where the completion system has a sensor array, according to an embodiment.

FIG. 1 shows an example two-stage completion system with an upper completion section 100 engaged with a lower completion section 102 in which the sensor array according to some embodiments can be deployed. Note that the sensor array according to some embodiments can be used in other example completion systems.

The two-stage completion system can be a sand face completion system that is designed to be installed in a well that has a region 104 that is un-lined or un-cased ("open hole region"). As shown in FIG. 1, the open hole region 104 is below a lined or cased region that has a liner or a casing 106. In the open hole region, a portion of the lower completion section 102 is provided proximate to a sand face 108.

To prevent passage into the well of particulate material, such as sand, a sand screen 110 is provided in the lower completion section 102. Alternatively, other types of sand control assemblies can be used, including slotted or perforated pipes or slotted or perforated liners. A sand control assembly is designed to filter particulates, such as sand, to prevent such particulates from flowing from a surrounding reservoir into a well.

In accordance with some embodiments, the lower completion section 102 has a sensor cable 112 that has multiple sensors 114 positioned at various discrete locations across the sand face 108. In some embodiments, the sensor cable 112 is in the form of a sensor cable (also referred to as a "sensor bridle"). The sensor cable has the multiple sensors 114 with cable segments 115 interconnecting the sensors 114. As discussed further below, the sensors 114 and cable segments 115 are sealingly connected together, such as by welding.

In the example lower completion section 102, the sensor cable 112 is also connected to a controller cartridge 116 that is able to supply regulated power and communicate with the sensors 114. Note that in some implementations the controller cartridge 116 can be part of the sensor cable 112. The controller cartridge 116 is able to receive commands from another location (such as at the earth surface or from another location in the well, e.g., from control station 146 in the upper completion section 100). These commands can instruct the controller cartridge 116 to cause the sensors 114 to take measurements or send measured data. Also, the controller cartridge 116 is able to store and communicate measurement data from the sensors 114. Thus, at periodic intervals, or in response to commands, the controller cartridge 116 is able to communicate the measurement data to another component (e.g., control station 146) that is located elsewhere in the wellbore, at the seabed, a subsea interface or at the earth surface. Generally, the controller cartridge 116 includes a processor and storage. The communication between sensors 114 and control cartridge 116 can be bi-directional or can use a master-slave arrangement.

The controller cartridge 116 is electrically connected to a first inductive coupler portion 118 (e.g., a female inductive coupler portion) that is part of the lower completion section 102. The first inductive coupler portion 118 allows the lower completion section 102 to electrically communicate with the upper completion section 100 such that commands can be issued to the controller cartridge 116 and the controller cartridge 116 is able to communicate measurement data to the upper completion section 100.

As further depicted in FIG. 1, the lower completion section 102 includes a packer 120 (e.g., gravel pack packer) that when set seals against casing 106. The packer 120 isolates an annulus region 124 under the packer 120, where the annulus region 124 is defined between the outside of the lower completion section 102 and the inner wall of the casing 106 and the sand face 108.

A seal bore assembly 126 extends below the packer 120, where the seal bore assembly 126 is able to sealably receive the upper completion section 100. The seal bore assembly 126 is further connected to a circulation port assembly 128 that has a slidable sleeve 130 that is slidable to cover or uncover circulating ports of the circulating port assembly 128. During a gravel pack operation, the sleeve 130 can be moved to an open position to allow gravel slurry to pass from the inner bore 132 of the lower completion section 102 to the annulus region 124 to perform gravel packing of the annulus region 124. The gravel pack formed in the annulus region 124 is part of the sand control assembly designed to filter particulates.

In the example implementation of FIG. 1, the lower completion section 102 further includes a mechanical fluid loss control device, e.g., formation isolation valve 134, which can be implemented as a ball valve.

As depicted in FIG. 1, the sensor cable 112 is provided in the annulus region 124 outside the sand screen 110. By deploying the sensors 114 of the sensor cable 112 outside the sand screen 110, well control issues and fluid losses can be avoided by using the formation isolation valve 134. Note that the formation isolation valve 134 can be closed for the purpose of fluid loss control or wellbore pressure control during installation of the two-stage completion system.

The upper completion section 100 has a straddle seal assembly 140 for sealing engagement inside the seal bore assembly 126 of the lower completion section 102. As depicted in FIG. 1, the outer diameter of the straddle seal assembly 140 of the upper completion section 100 is slightly smaller than the inner diameter of the seal bore assembly 126 of the lower completion section 102. This allows the upper completion section straddle seal assembly 140 to sealingly slide into the lower completion section seal bore assembly 126. In an alternate embodiment the straddle seal assembly can be replaced with a stinger that does not have to seal.

Arranged on the outside of the upper completion section straddle seal assembly 140 is a snap latch 142 that allows for engagement with the packer 120 of the lower completion section 102. When the snap latch 142 is engaged in the packer 120, as depicted in FIG. 1, the upper completion section 100 is securely engaged with the lower completion section 102. In other implementations, other engagement mechanisms can be employed instead of the snap latch 142.

Proximate to the lower portion of the upper completion section 100 (and more specifically proximate to the lower portion of the straddle seal assembly 140) is a second inductive coupler portion 144 (e.g., a male inductive coupler portion). When positioned next to each other, the second inductive coupler portion 144 and first inductive coupler portion 118 (as depicted in FIG. 1) form an inductive coupler that allows for inductively coupled communication of data and power between the upper and lower completion sections.

An electrical conductor 147 (or conductors) extends from the second inductive coupler portion 144 to the control station 146, which includes a processor and a power and telemetry module (to supply power and to communicate signaling with the controller cartridge 116 in the lower completion section 102 through the inductive coupler). The control station 146 can also optionally include sensors, such as temperature and/or pressure sensors.

The control station 146 is connected to an electric cable 148 (e.g., a twisted pair electric cable) that extends upwardly to a contraction joint 150 (or length compensation joint that accommodates mechanical tolerances and thermally induced expansion or contraction of the completion equipment). At the contraction joint 150, the electric cable 148 can be wound in a spiral fashion (to provide a helically wound cable) until the electric cable 148 reaches an upper packer 152 in the upper completion section 100. The upper packer 152 is a ported packer to allow the electric cable 148 to extend through the packer 152 to above the ported packer 152. The electric cable 148 can extend from the upper packer 152 all the way to the earth surface (or to another location in the well, at the seabed, or other subsea location).

In other implementations, some of the components depicted in FIG. 1 can be omitted or replaced with other types of components. Also, the sensor cable 112 according to some embodiments can be used without inductive couplers. For example, the sensor cable 112 can be deployed inside a tubing string to measure characteristics of fluids inside the tubing string. In other implementation, the sensor cable 112 can be deployed outside a casing or liner to detect conditions outside the casing or liner.

Figure 2:
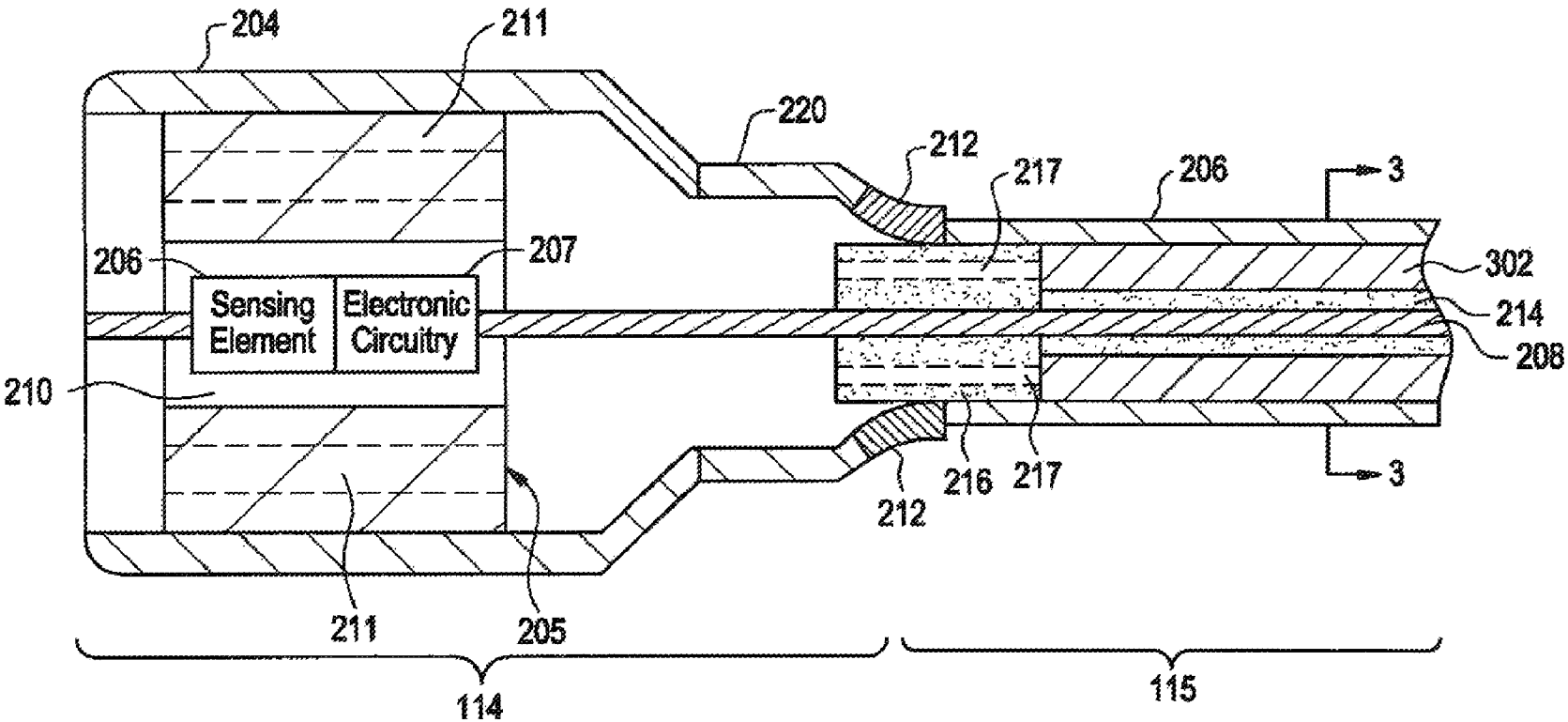
FIG. 2 illustrates a portion of a sensor array, according to an embodiment.

In one embodiment, the sealing engagement between sensors and cable segments is accomplished using welding. FIG. 2 shows the welded connection of a sensor 114 to a cable segment 115. Additional welded connections are provided at other points along the sensor cable 112 to connect other pairs of sensors and cable segments. The sensor 114 has a sensor housing 204 for housing a sensing element 206 and associated electronics circuitry 207. The sensing element 206 can be a temperature sensing element, pressure sensing element, or any other type of sensing element. The sensing element 206 and electronics circuitry 207 are arranged inside a chamber 210 defined by a sensing element support structure 205. Although the sensing element 206 is depicted as being completely contained inside the chamber 210 of the sensing element support structure 205, it is noted that some part of the sensing element, such as a pressure sensor's diaphragm or bellows, a flow sensor's spinner, or a pH sensor's electrode can be exposed to the outside environment (wellbore environment) in other implementations.

The cable segment 115 has a cable housing 206 that can be welded to the sensor housing 204 through an intermediate housing section 220. The cable segment 115 includes a wire 208 (or plural wires), contained inside the cable housing 206, connected to the electronics circuitry 207. The cable segment 115 also includes an insulative layer 214 that is defined between the wire 208 and the cable housing 206. The insulative layer 214 can be made from a polymeric material, for example. The wire 208 and insulative layer 214 together form a "wire assembly." As explained further below in connection with FIG. 3, a support structure 302 is provided between the wire assembly and the cable housing 206 to define an inner fluid path inside the cable housing 206.

Also provided in the cable segment 202 is a heat insulator 216 that is positioned between the cable housing 206 and the wire 208. The heat insulator 216 is generally cylindrical in shape with a generally central bore through which the wire 208 can pass. The heat insulator 216 protects the wire 208 in the vicinity of a weld 212 (e.g., a socket weld), as well as protects the insulative layer 214 from melting and outgassing, which can result in poor weld quality, and produce corrosive vapors and electrically conductive particulates within the cable housing that could endanger the sensors' operation or their measurement precision. The weld 212 is provided between the intermediate housing section 220 and the cable housing 206. Note that the weld 212 is far enough away from the sensing element 206 and electronics circuitry 207 that heat from the weld 212 would not cause damage to the sensing element 206 and the electronics circuitry 207. In another implementation, a butt weld can be used instead.

Figure 3:
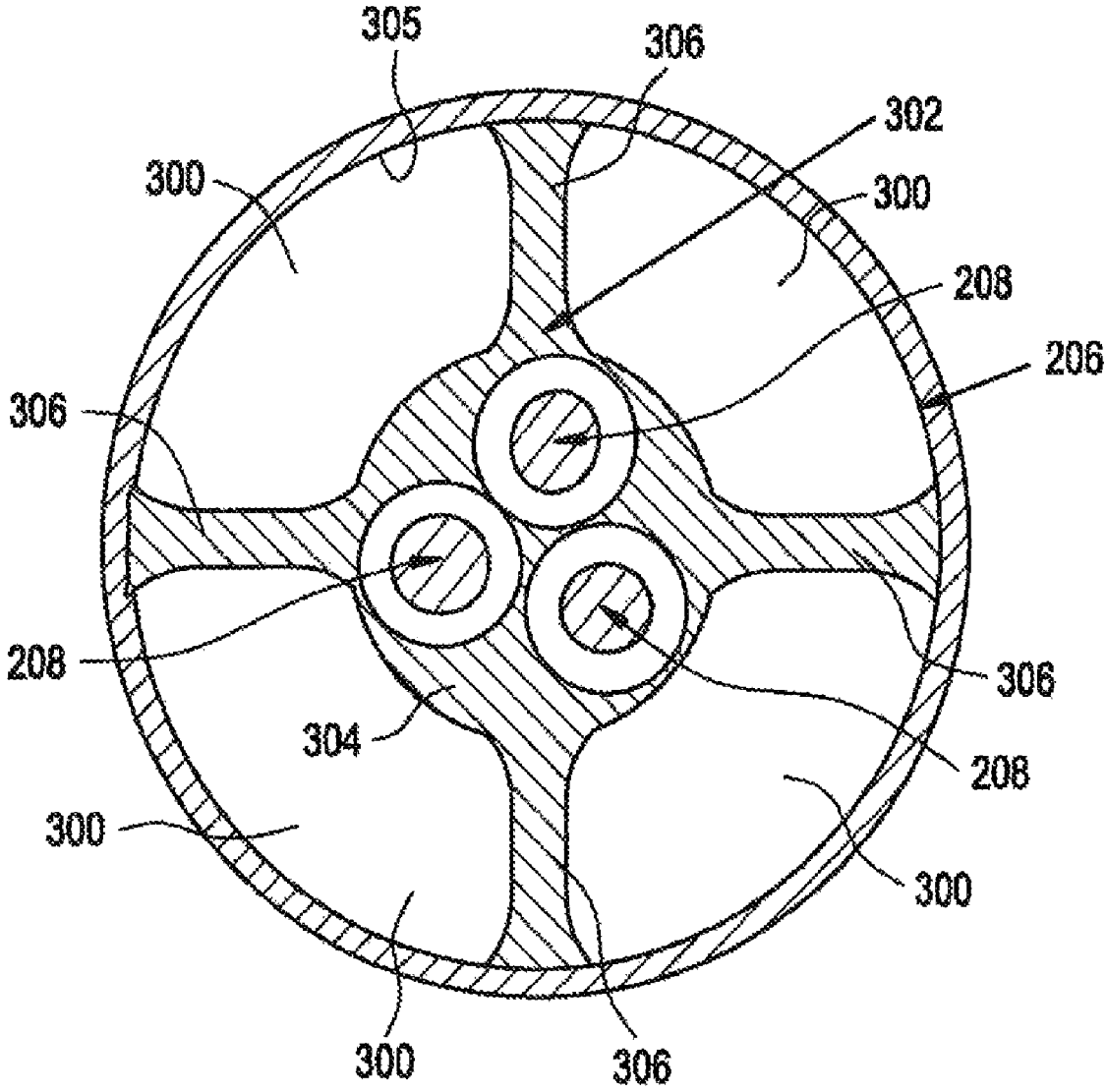
FIG. 3 shows a cross-sectional view of the sensor array of FIG. 2, according to an embodiment.

A further feature to improve the quality and reliability of welds 212 along the length of the sensor cable 112 is to define fluid flow paths inside the sensor cable 112 to allow flow of an inert gas (e.g., argon, nitrogen, helium, or other inert gases). In some implementations, the inert gas that is flowed inside the sensor cable 112 contains a mixture with a maximum of 10% helium and a minimum of 90% of one of argon or nitrogen. In another implementation, the inert gas that is flowed inside the sensor cable 112 contains a mixture with a maximum of 5% helium and a minimum of 95% of one of argon or nitrogen. The cross-sectional view of a portion of a cable segment 115 is depicted in FIG. 3, which shows three wire assemblies 208 arranged in generally the center of the cable segment. Each wire assembly 208 includes a wire (electrical conductor) surrounded by an electrically insulative layer.

To define fluid paths 300 inside the cable segment, a support structure 302 is employed, where the support structure extends between the inner surface 305 of the housing 206 and the wire assemblies 208 to provide support. The example support structure 302 depicted in FIG. 3 includes a central hub 304 disposed in contact with the wire assemblies and a plurality of wings 306 that extend radially outwardly to the inner surface 305 of the housing 206. The wings 306 of the support structure 302 define four uninterrupted fluid paths 300, in the depicted example. In other examples, different numbers of wings can be used to define different numbers of fluid paths inside the cable segment.

Note that, as depicted in FIG. 2, the sensing element support structure 205 and the heat insulator 216 of FIG. 2 define similar longitudinal paths 211 and 217, respectively, corresponding to the fluid flow paths 300 of the cable segment 115 to allow uninterrupted fluid flow inside the sensor cable along its entire length.

The support structure 306 can have any of different types of shapes, such as the hub shape depicted in FIG. 3, or triangular shapes, cloverleaf shapes, and so forth, provided that the support structure 306 is non-circular and provides the following two features: (1) sufficient mechanical interference between the wire assembly(ies) 208 and the housing 206 to prevent dropout (the wire assembly(ies) dropping out longitudinally from the cable housing 206), and (2) sufficient flow area to flow an inert gas through the inside of the cable housing 206 without high pressure requirements.

Figure 4:
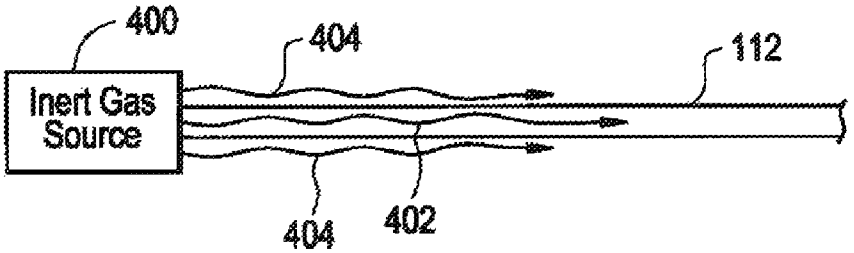
FIGS. 4-6 show various setups used when assembling a sensor array, according to some embodiments.

During welding of sensor housings and cable housings, a continuous flow of an inert gas can be passed through the longitudinal fluid paths inside the sensor cable 112, as indicated by 402 in FIG. 4. The inert gas (which can be argon or nitrogen, for example) is produced by an inert gas source 400. The inert gas source 400 can also cause inert gas flow (404) along the outside surface of the sensor cable 112 during welding. The utilization of the inert gas flows during welding limits weld sugars and oxidation to improve the quality and reliability of the welds 212 of FIG. 2.

In some embodiments, after welding has been performed, a pressurized gas source (which can be the inert gas source 400 or some other gas source) can be attached to the sensor cable 112 for the purpose of generating a pressurized flow of gas inside the sensor cable 112. This pressurized flow of inert gas is performed to eliminate or purge corrosive gases, moisture, oxidation, and welding by-products from the inside of the sensor cable to enhance the life of the sensing elements and associated electronic devices in the sensor cable.

Figure 5:
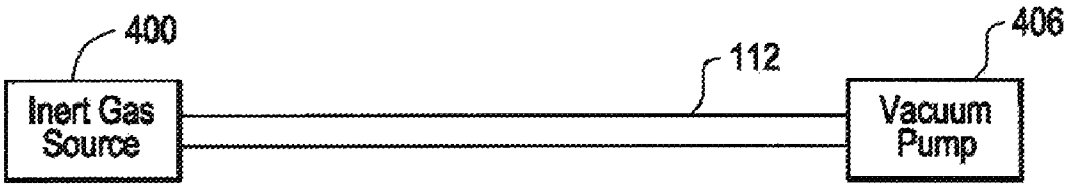

In a different implementation, as depicted in FIG. 5, one end of the sensor cable 112 is attached to the inert gas source 400 (which does not have to be pressurized), while the other end is attached to a vacuum pump 406. The vacuum pump 406 when activated induces a vacuum inside the sensor cable 112, which helps to suck any gases, moisture, oxidation, and welding by-products from the inside of the sensor cable 112.

Whether a pressurized gas source or a vacuum pump is used, the technique for removing undesirable elements or vapors from inside the sensor cable is accomplished by creating a pressure differential between the two ends of the sensor cable 112. In the first case, the pressurized gas source causes an increase in pressure at one end such that elements or vapors inside the sensor cable 112 are pushed outwardly through the other end of the sensor cable. In the second case, the vacuum pump causes the pressure differential to be created to cause suction of the undesirable elements or vapors inside the sensor cable 112.

Once the suction has been completed by the vacuum pump 402, the inert gas source 400 can be turned on to cause a flow of inert gas inside the sensor cable 112. This is a backfilling process to re-fill the inside of the sensor cable 112 with an inert gas after the vacuum suction has completed to prevent atmospheric air (which contains moisture and oxygen) from flowing into the sensor cable 112, which can cause corrosion inside the sensor cable 112.

Figure 6:
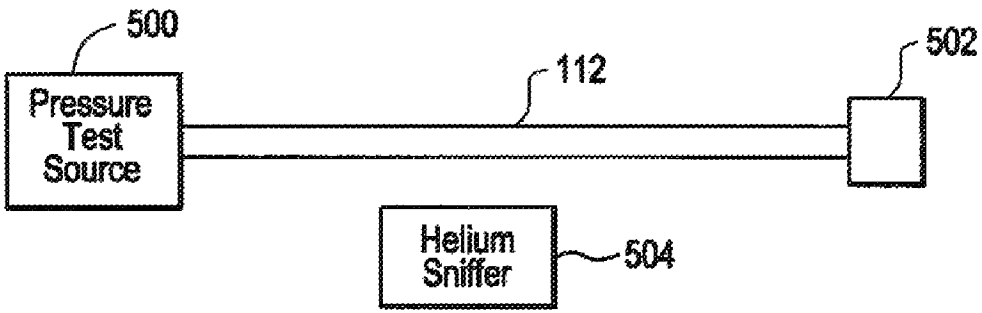

FIG. 6 shows an arrangement for pressure testing the sensor cable 112, which includes a pressure test source 500 attached to one end of the sensor cable 112, and some type of a sealing mechanism 502 attached to the other end of the sensor cable 112. The sealing mechanism 502 can be a cap that is attached to one end of the sensor cable 112. Alternatively, instead of using the cap, the uppermost sensor in the sensor cable 112 can be modified from the other sensors by replacing the electronic circuitry with a gel that fills the entire inner diameter of the sensor. This gel acts as a seal. The pressure test source 500 induces increased pressure inside the sensor cable 112 by pumping pressurized inert gas into the fluid flow paths of the sensor cable 112. In one implementation, the inert gas used can be helium, or a mixture of helium and an inert gas such as argon or nitrogen. One or more helium sniffers 504 can be provided outside the sensor cable 112 to detect any leaks of helium from the sensor cable 112. When a helium gas mixture is used during welding, the helium concentration has to be sufficiently low to avoid interfering with the proper heat transfer and metallurgy of the welding process. For an argon-helium mixture as the shielding gas for a Gas Tungsten Arc Welding (GTAW) or Tungsten Inert Gas (TIG) welding process, the concentration of helium is typically less than 10%. Hydrogen is another candidate for detecting leaks because below a concentration of 5.7% in air, hydrogen is non-flammable. Also hydrogen detectors are potentially sensitive, simple, and inexpensive. In different implementations, other types of gas and gas detectors can be used for detecting leakage of other gases generated by the pressure test source 500 inside the sensor cable 112.

By using the techniques discussed above, a reliable sensor array having multiple discrete sections sealably connected to each other can be provided. By ensuring proper sealing in the connections of the discrete sections of the sensor array, the likelihood or probability of failure of the sensor array due to leakage of well fluids into the sensor array is reduced.

Also, according to some embodiments, it is possible to perform customized adjustments of the sensor cable 112 at the job site, such as on a rig. Normally, the sensor cable 112 is assembled at a factory and delivered to the job site. However, at the job site, the operator may detect defects in one or more sections of the sensor cable 112. If that occurs, rather than send the sensor cable back to the factory for repair or order another sensor cable, the well operator can fix the sensor cable by cutting away the sections that are defective and performing welding to re-attach the sensor array sections, as discussed above. Also, equipment to remove undesirable elements, to fill the inside of the sensor cable with an inert gas, and to test the welded connections can be provided at the job site to ensure that the sensor cable has been properly welded.

Figure 7:
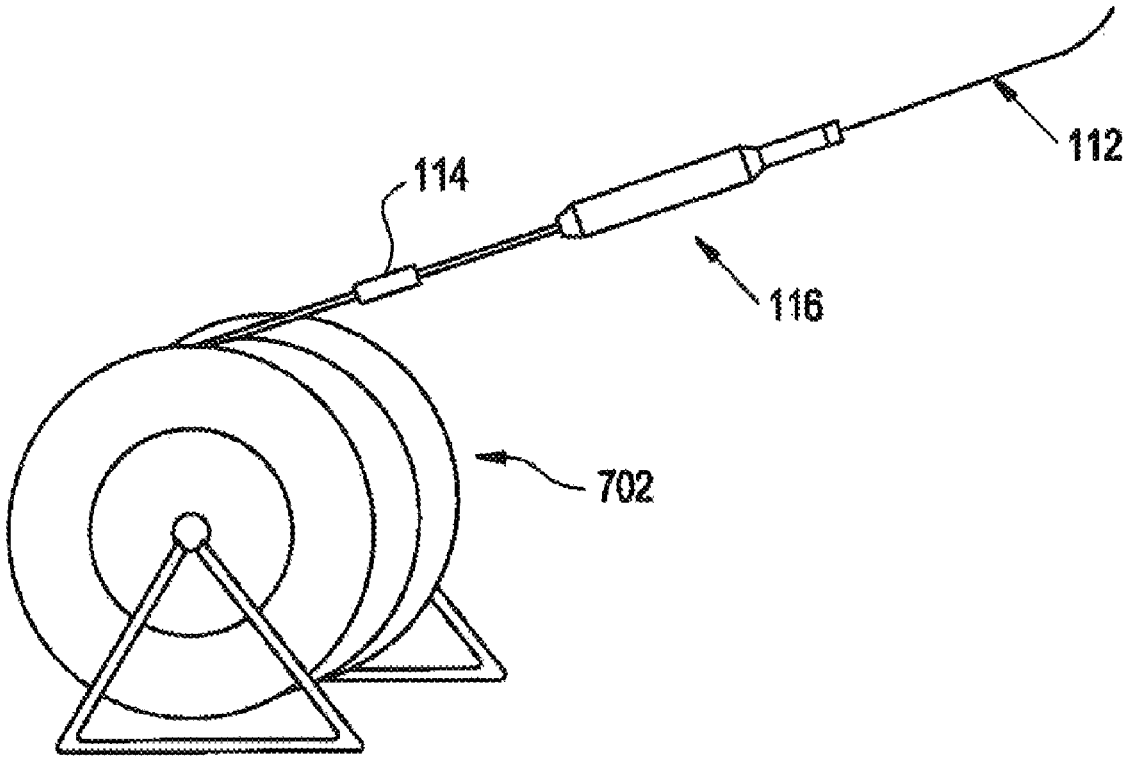
FIG. 7 illustrates a spool on which a sensor cable is wound, according to an embodiment.

FIG. 7 shows a sensor cable 112 that is deployed on a spool 602. As depicted in FIG. 7, the sensor cable 112 includes the controller cartridge 116 and a sensor 114. Additional sensors 114 that are part of the sensor cable 112 are wound onto the spool 702. To deploy the sensor cable 112, the sensor cable 112 is unwound until a desired length (and number of sensors 114) has been unwound, and the sensor cable 112 can be cut and attached to a completion system.

Figure 8:
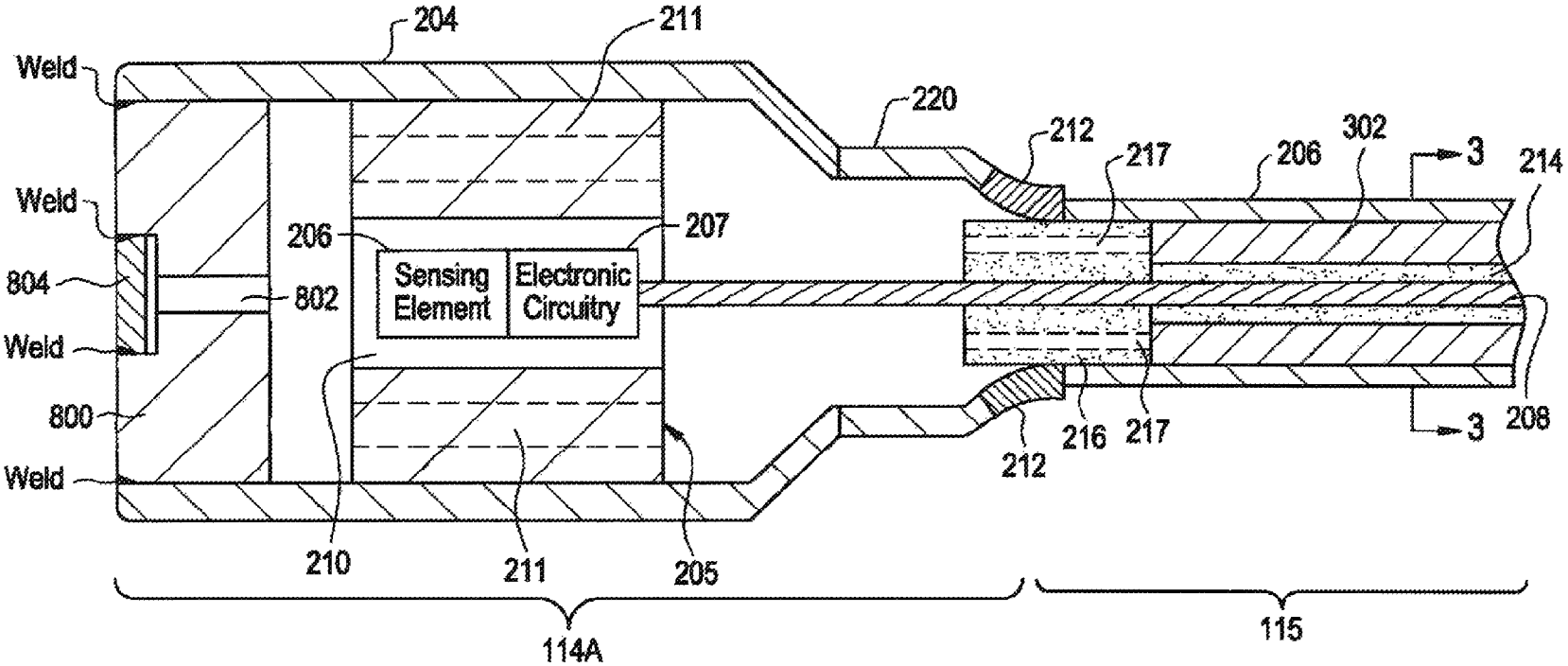
FIG. 8 illustrates a portion of the sensor array that includes a bottom sensor, according to an embodiment.

In some implementations, the bottom sensor can have a different configuration from other sensors of the sensor cable 112. As depicted in FIG. 8, a bottom sensor 114A has a plug 800 with an axial flow port 802 that extends through the plug 800. Inert gas can be injected through the flow port 802 during welding as well as to fill the inner bore of the sensor cable with an inert gas. The flow port 802 can be coupled to an inert gas source. The plug 800 is welded to the sensor housing 204. Once the sensor cable is filled with an inert gas, a cap 804 can be welded to the plug 800 to cover the flow port 802 to seal the inert gas in the sensor cable.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A sensor array comprising:

plural sensors having corresponding sensor housings;

plural cable segments to interconnect the sensors, wherein the cable segments have respective cable housings and wire assemblies; and heat insulating structures positioned to protect the wire assemblies from heat during a sealing procedure to interconnect the sensor housing and cable housings, wherein each of the plural sensors includes a sensing element support structure that contains a sensing element and associated electronics circuitry, wherein the electronics circuitry is electrically connected to at least one wire assembly.

2. The sensor array of claim 1, wherein the sealing procedure comprises a welding procedure.

3. The sensor array of claim 1, wherein each cable segment further comprises a support structure between at least one wire assembly inside the cable segment and a cable housing of the cable segment, wherein the support structure defines at least one fluid flow path inside the cable segment.

4. The sensor array of claim 3, wherein the support structure comprises a hub and wings extending from the hub to an inner surface of the cable housing.

* * * * *